US008022922B2

(12) United States Patent
Kang

(10) Patent No.: US 8,022,922 B2
(45) Date of Patent: Sep. 20, 2011

(54) LIQUID CRYSTAL DISPLAY AND METHOD OF DRIVING THE SAME

(75) Inventor: Ki-hyung Kang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 776 days.

(21) Appl. No.: 11/585,238

(22) Filed: Oct. 24, 2006

(65) Prior Publication Data

US 2007/0091059 A1 Apr. 26, 2007

(30) Foreign Application Priority Data

Oct. 26, 2005 (KR) ..... 10-2005-0101489

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 5,136,282 | A * | 8/1992 | Inaba et al. | 345/97 |
| 6,956,555 | B2 * | 10/2005 | Kyomoto | 345/102 |
| 2002/0000960 | A1 * | 1/2002 | Yoshihara et al. | 345/87 |
| 2002/0057241 | A1 | 5/2002 | Oda et al. | |
| 2003/0020677 | A1 | 1/2003 | Nakano | |
| 2003/0043097 | A1 * | 3/2003 | Shingai et al. | 345/87 |
| 2004/0183773 | A1 * | 9/2004 | Song | 345/102 |

FOREIGN PATENT DOCUMENTS

| | | | |
|---|---|---|---|
| CN | 1543636 | A | 11/2004 |
| JP | 10-048595 | A | 2/1998 |
| JP | 2000-147454 | A | 5/2000 |
| JP | 2000-275605 | A | 10/2000 |
| JP | 2000-322018 | A | 11/2000 |
| JP | 2000322018 | A * | 11/2000 |
| JP | 2001-125066 | A | 5/2001 |
| JP | 2002-082654 | A | 3/2002 |
| JP | 2004-206044 | A | 7/2004 |
| KR | 10-2003-001995 | A | 3/2003 |
| KR | 10-2003-0096904 | A | 12/2003 |
| KR | 1020040061661 | | 7/2004 |
| WO | WO 03/019271 | A2 | 3/2003 |

OTHER PUBLICATIONS

European Office Action issued in Application No. 06122745.0, dated Nov. 15, 2010.

* cited by examiner

*Primary Examiner* — Richard Hjerpe
*Assistant Examiner* — Carolyn R Edwards
(74) *Attorney, Agent, or Firm* — Sughrue Mion, PLLC

(57) ABSTRACT

A liquid crystal display (LCD) and a method of driving the same are provided. The LCD includes a liquid crystal panel partitioned into a plurality of panel regions, each panel region being independently driven and having data lines and gate lines; a backlight unit that is partitioned into a plurality of backlight regions corresponding to the plurality of panel regions and which irradiates light to the plurality of panel regions; and a driver unit driving the plurality of panel regions.

16 Claims, 8 Drawing Sheets

LIQUID CRYSTAL DISPLAY AND METHOD OF DRIVING THE SAME

CROSS-REFERENCE TO RELATED PATENT APPLICATION

This application claims priority from Korean Patent Application No. 10-2005-0101489, filed on Oct. 26, 2005, in the Korean Intellectual Property Office, the disclosure of which is incorporated herein in its entirety by reference.

BACKGROUND OF THE INVENTION

1. Field of the Invention

Apparatuses and methods consistent with the present invention relate to a liquid crystal display (LCD) and a method of driving the same, and more particularly, to an LCD with an improved frame rate and brightness and a method of driving the same.

2. Description of the Related Art

LCDs display images by applying a voltage to each pixel on a liquid crystal panel according to an input image signal and adjusting transmittance of light for each pixel and are used in notebooks, desktop computers, LCD-TVs, and mobile communication terminals. An LCD is a non-emissive flat panel display that needs external light to produce images since it does not emit light. Thus, an LCD requires a backlight unit that is located behind a liquid crystal panel and a driver unit for driving the liquid crystal panel.

FIG. 1 is a schematic diagram of a related LCD. Referring to FIG. 1, the related LCD includes a liquid crystal panel 10, a backlight unit 35 supplying light to the liquid crystal panel 10, and a driver unit driving the liquid crystal panel 10. The liquid crystal panel 10 includes m×n liquid crystal pixels arranged in a matrix form, m data lines $D_1$ through $D_m$ and n gate lines $G_1$ through $G_n$ arranged to intersect each other, and thin film transistors (TFTs) disposed at positions where the data lines $D_1$ through $D_m$ and the gate lines $G_1$ through $G_n$ intersect. The driver unit includes a data driver 15 supplying data signals to the data lines $D_1$ through $D_m$, a gate driver 20 supplying scan signals to the gate lines $G_1$ through $G_n$, a timing controller 25 controlling the data driver 15 and the gate driver 20 using a synchronization signal, and an inverter 30 driving the backlight unit 35.

The TFT formed in each liquid crystal pixel performs a switching operation according to a data signal supplied from a corresponding one of the data lines $D_1$ through $D_m$ in response to a scan signal supplied from a corresponding one of the gate lines $G_1$ through $G_n$.

The timing controller 25 uses a vertical/horizontal synchronization signal to generate control signals for the gate driver 20 and the data driver 15. The data driver 15 converts digital image signals into analog data signals in response to the control signal received from the timing controller 25 and supplies the analog data signals to the data lines $D_1$ through $D_m$. The gate driver 20 sequentially supplies scan pulses to the gate lines $G_1$ through $G_n$ in response to the control signal received from the timing controller 25 and selects horizontal lines of the liquid crystal panel to which data signals are supplied. The inverter 30 supplies a driving voltage to the backlight unit 35. The backlight unit 35 generates a beam corresponding to the driving voltage and supplies the beam to the liquid crystal panel 10.

TFTs are the most common type of switching devices used in LCDs, and LCDs using TFTs as switching devices are referred to as TFT-LCDs. Producing a color image in a LCD is accomplished by spatial division in which each pixel represents one of red (R), green (G), and blue (B) or time division in which every pixel sequentially represents R, G, and B colors. When the time division method is used, the LCD includes R, G, and B light sources that are sequentially turned on. More specifically, after all pixels are scanned according to the operation of a gate driver and a data driver, a red light source is turned on and then off. All pixels are scanned again and then a green light source is turned on. The green light source is turned off and all pixels are scanned again before a blue light source is turned on. On the other hand, according to the spatial division method, R, G, and B color filters are disposed in respective regions corresponding to pixel electrodes to realize respective colors. Thus, when an LCD operates at the same frame frequency, the time division method requires a shorter time during which each color light source is turned on than taken using the spatial division method.

Meanwhile, to display a moving image, the response rate and operating speed of liquid crystals must be equal to or greater than the number of frames in the moving images. Further, LCD frame frequency must be increased to realize a high-resolution precise moving image. When the response rate and operating speed of liquid crystals are low, the screen may appear crumpled or scattered because there is insufficient time to arrange the liquid crystals in a liquid crystal panel. Moreover, because the response rate and operating speed of liquid crystals can be increased only by limited degree, it is also difficult to increase frame frequency.

FIG. 2 illustrates arranging lines of a liquid crystal panel with respect to time showing a process of aligning liquid crystals according to data supplied from a data driver and corresponding color light being supplied with respect to time.

The time during which liquid crystals are switched from an "off" state to an "on" state according to a data signal is called rising time ($\tau$) and the time during which all liquid crystals are switched from an "on" state to an "off" state is called falling time. The designations S, U, and T denote a rising interval, an interval during which the liquid crystals remain in the on state, and a falling interval, respectively. A backlight unit supplies light during interval U. This process is repeated sequentially for R, G, and B colors. For example, when the total time taken for the liquid crystal panel to display an image frame is 16 msec, data is supplied for less than 2 msec, and all TFTs are turned on for less than 8 msec to align liquid crystals, light must be supplied for less than 6 msec. Thus, as frame frequency decreases, the time during which light is supplied becomes shorter, thus resulting in significant degradation of brightness. Further, as LCD screen size increases, brightness degradation becomes more severe because the time taken for the liquid crystal panel to turn on increases.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

An aspect of the present invention provides a liquid crystal display (LCD) for providing a high quality image by increasing frame frequency of a liquid crystal panel while the response rate remains constant and a method of driving the LCD.

An aspect of the present invention also provides an LCD having an increased frame rate and brightness and a method of driving the LCD.

According to an aspect of the present invention, there is provided an LCD including: a liquid crystal panel that is partitioned into a plurality of panel regions, each panel region being independently driven and having data lines and gate lines; a backlight unit that is partitioned into a plurality of backlight regions corresponding to the plurality of panel regions and that irradiate light to the panel regions; and a driver unit that drives the panel regions.

The driver unit includes: a plurality of data drivers, one for each of the panel regions, that supply data signals to the data lines; a plurality of gate drivers, one for each of the panel regions, that supply scan signals to the gate lines; an inverter that drives the backlight unit; and a timing controller that controls the inverter and the data drivers and the gate drivers using vertical and horizontal synchronization signals, respectively. The panel regions may be driven simultaneously.

The backlight unit includes a plurality of color light sources that emit light of different colors and the liquid crystal panel and the backlight unit are sequentially driven for each color. The liquid crystal panel may be vertically partitioned with respect to the data lines. The backlight regions in the backlight unit may be driven simultaneously in response to a vertical synchronization signal received from the timing controller.

Each of the backlight regions is vertically partitioned with respect to the data lines into sub-regions and light is cyclically supplied from light sources in a sub-region of the sub-regions after a scan is completed for a panel region disposed opposite the sub-region.

According to another aspect of the present invention, the LCD may include: a liquid crystal panel vertically partitioned with respect to the data lines into first and second panel regions, each panel region being independently driven and having data lines and gate lines arranged in a two-dimensional array; a backlight unit having first and second backlight regions that are disposed opposite the first and second panel regions, respectively, and that irradiate light to the first and second panel regions; and a driver unit that independently drives the first and second panel regions.

The driver unit includes: a first data driver that supplies data signals to data lines in the first panel region; a first gate driver that supplies scan signals to gate lines in the first panel region; a second data driver that supplies data signals to data lines in the second panel region; and a second gate driver that supplies scan signals to gate lines in the second panel region; an inverter that drives the first and second backlight regions; and a timing controller that controls the first and second data drivers and gate drivers using vertical and horizontal synchronization signals, respectively, and controls the inverter in synchronization with the first and second data drivers.

According to another aspect of the present invention, there is provided a method for driving an LCD including the steps of: partitioning a liquid crystal panel having data lines and gate lines into a plurality of panel regions that can be independently driven; simultaneously driving the panel regions; partitioning a backlight unit into a plurality of backlight regions corresponding to the panel regions; and irradiating light from each of the backlight regions after completing a scan of a corresponding panel region.

The driving the panel regions includes: supplying data signals to data lines in the panel regions using data drivers, one for each of the panel regions; supplying scan signals to gate lines in the panel regions using gate drivers, one for each panel region; and controlling the data drivers and the gate drivers using vertical and horizontal synchronization signals, respectively.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF THE EXEMPLARY EMBODIMENTS OF THE INVENTION

Figure 1:
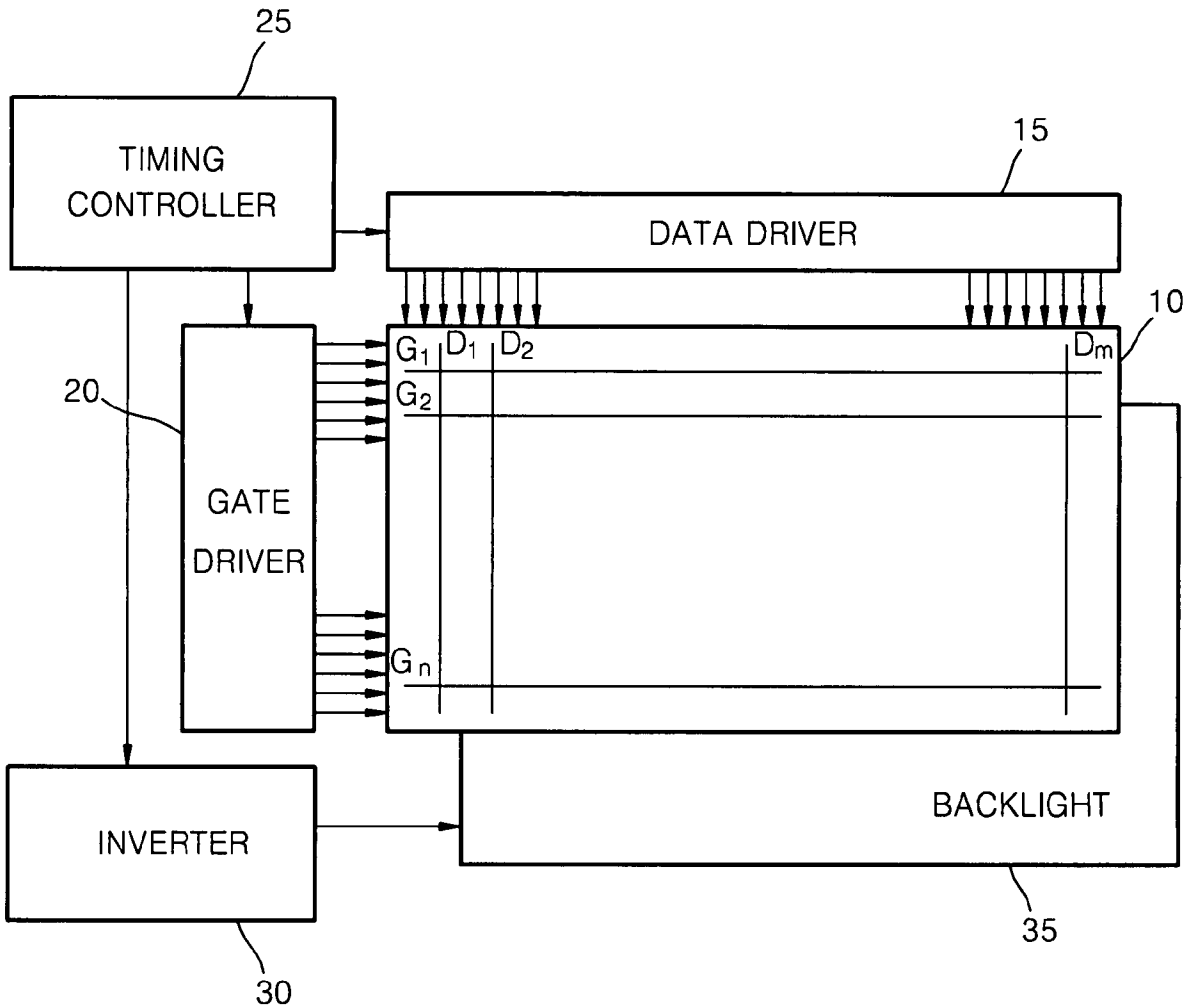
FIG. 1 (RELATED ART)
FIG. 1 schematically illustrates a related liquid crystal display (LCD)
Figure 2:
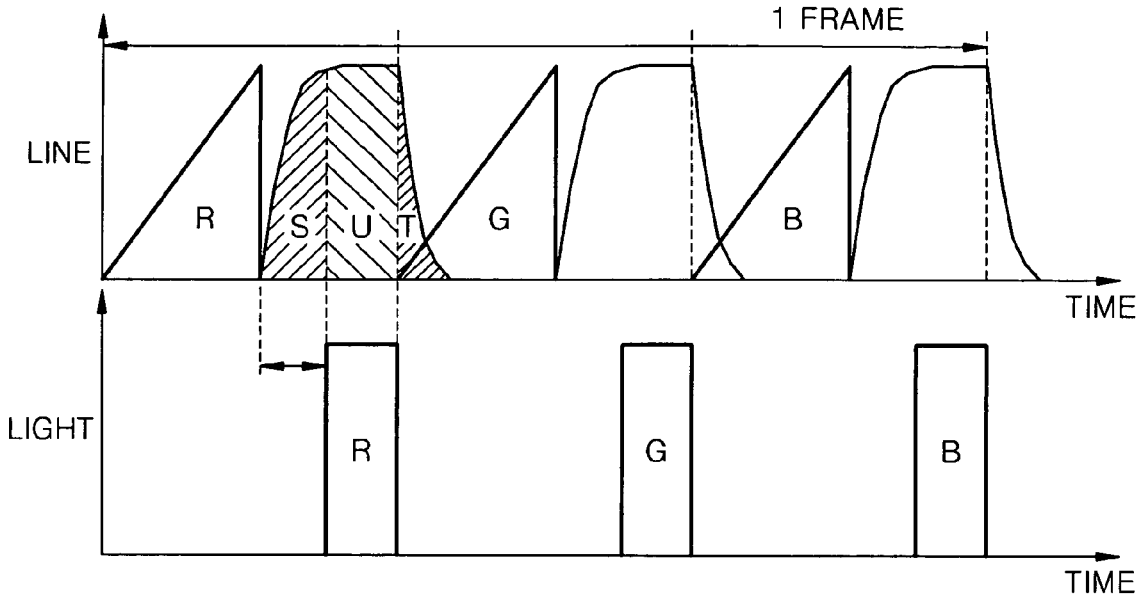
FIG. 2 (RELATED ART)
FIG. 2 illustrates a driving scheme for a related LCD.
Figure 3:
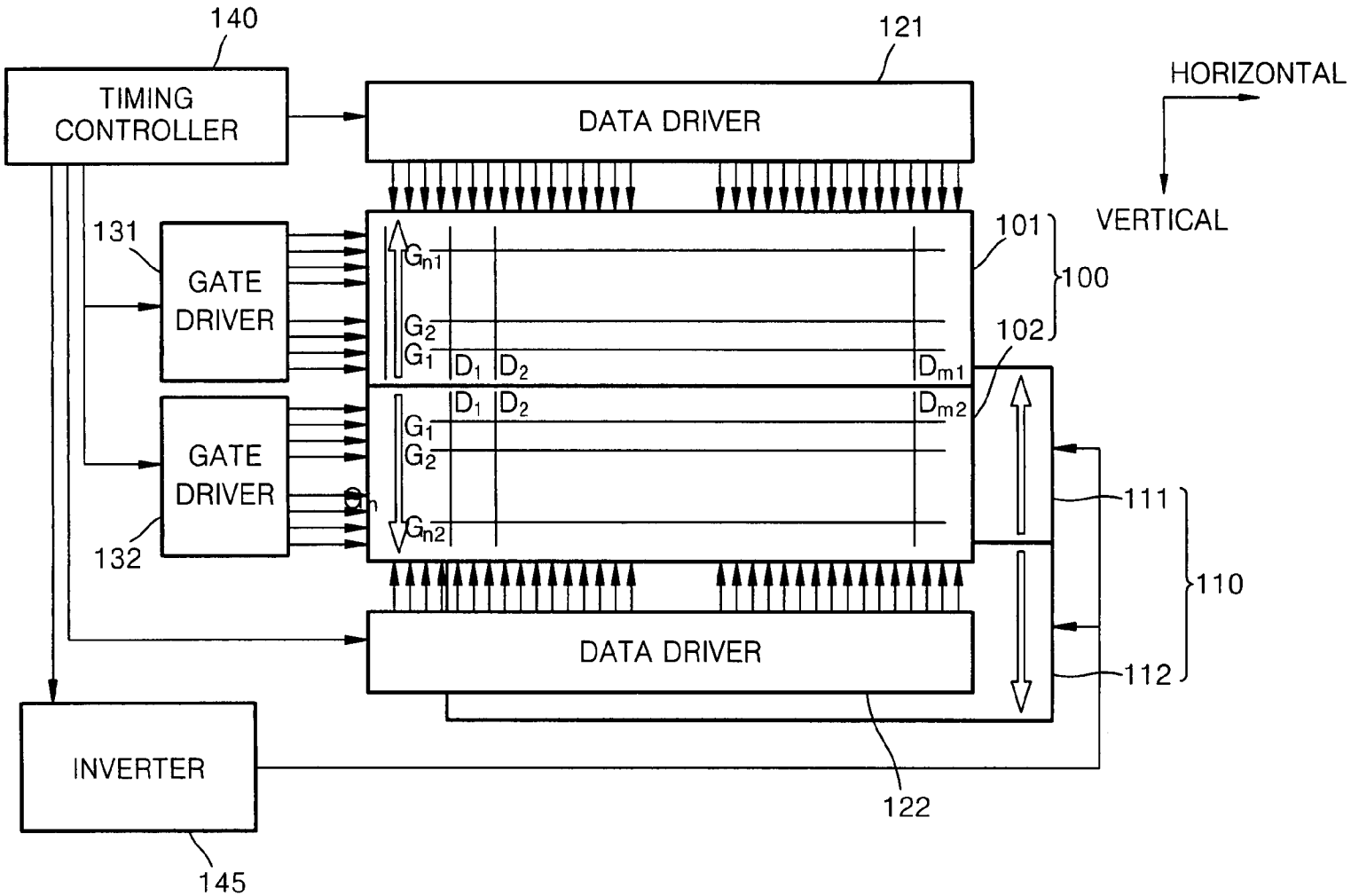
FIG. 3 is a schematic diagram of an LCD according to an exemplary embodiment of the present invention.

Hereinafter, the present invention will be described in detail by explaining exemplary embodiments of the invention with reference to the attached drawings. FIG. 3 is a schematic diagram of an LCD according to an exemplary embodiment of the present invention. Referring to FIG. 3, the LCD includes a liquid crystal panel 100 divided into a plurality of panel regions, and a backlight unit 110 supplying light to the panel regions.

The backlight unit 110 includes backlight regions corresponding to the panel regions. The LCD further includes a data driver and a gate driver for each panel region. The data driver and the gate driver respectively supply a data signal and a scan signal to a corresponding panel region.

For example, the liquid crystal panel 100 may include first and second panel regions 101 and 102 and the backlight unit 110 includes first and second backlight regions 111 and 112 corresponding to the first and second panel regions 101 and 102. The LCD further includes first and second data drivers 121 and 122 for supplying data signals to data lines in the first and second panel regions 101 and 102, respectively, and first and second gate drivers 131 and 132 for supplying scan signals to gate lines in the first and second panel regions 101 and 102, respectively.

The first and second data drivers 121 and 122 and the first and second gate drivers 131 and 132 are controlled by a timing controller 140. The timing controller 140 uses a horizontal synchronization signal to control the first and second data drivers 121 and 122. The timing controller 140 also uses a vertical synchronization signal to control the first and second gate drivers 131 and 132. The backlight unit 110 is driven by an inverter 145 that is controlled by the timing controller 140.

The first panel region 101 of the liquid crystal panel 100 includes m1×n1 liquid crystal pixels arranged in a matrix, m1 data lines $D_1$ through $D_{m1}$ and n1 gate lines $G_1$ through $G_{n1}$ arranged to intersect each other, and thin film transistors (TFTs) disposed at positions where the data lines $D_1$ through $D_{m1}$ and the gate lines $G_1$ through $G_{n1}$ intersect. The second panel region 102 includes m2×n2 liquid crystal pixels arranged in a matrix, m2 data lines $D_1$ through $D_{m2}$ and n2 gate lines $G_1$ through $G_{n2}$ arranged to intersect each other, and thin film transistors (TFTs) disposed at positions where the data lines $D_1$ through $D_{m2}$ and the gate lines $G_1$ through $G_{n2}$ intersect.

The liquid crystal panel 100 may be vertically partitioned into a plurality of panel regions with respect to the data lines $D_1$ through $D_{m1}$. According to the current exemplary embodiment of the present invention, the liquid crystal panel 100 is divided into the two panel regions 101 and 102. The backlight unit 110 is divided into the first and second backlight regions 111 and 112 corresponding to the first and second panel regions 101 and 102 and irradiates light onto the corresponding panel regions 101 and 102.

The first and second panel regions 101 and 102 may be simultaneously driven through their corresponding gate drivers and the data drivers. The first panel region 101 is scanned and then irradiated with light emitted from the first backlight region 111. At the same time, the second panel region 102 is scanned and then irradiated with light emitted from the second backlight region 112. The first and second panel regions 101 and 102 can be scanned from top to bottom or from bottom to top.

Figure 4A:
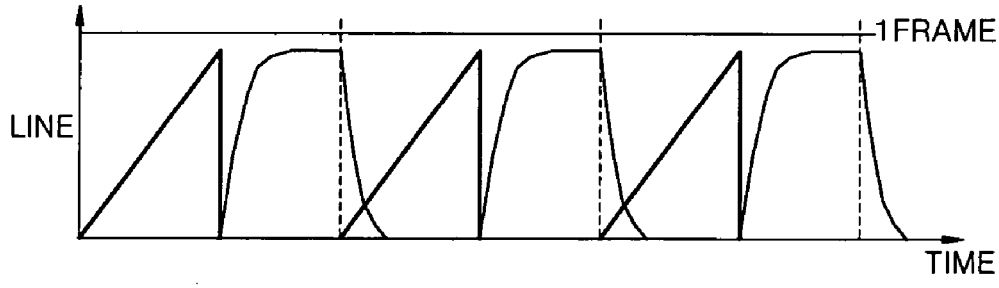
FIGS. 4A and 4B are timing diagrams respectively showing time taken to form one frame for a related LCD and time taken to display one frame for the LCD of FIG. 3.
Figure 4B:
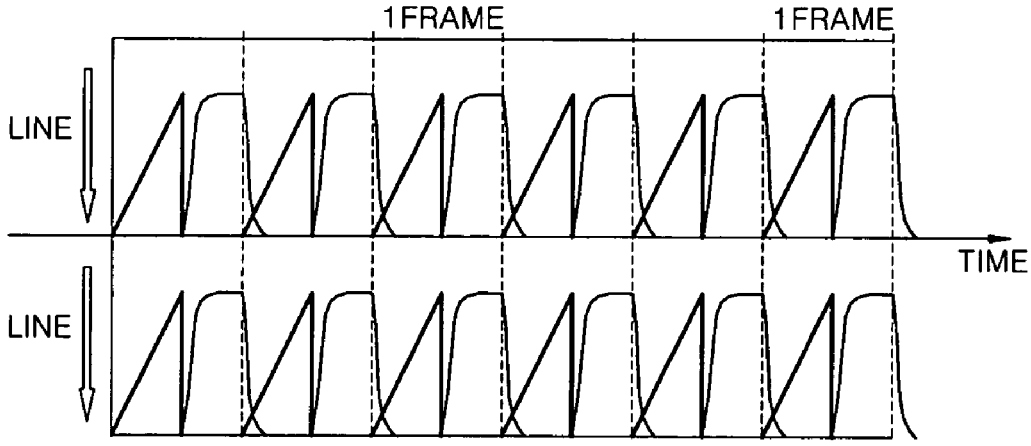

FIG. 4A is a timing diagram showing time taken to display one frame when a related liquid crystal panel is constituted of a single region and FIG. 4B is a timing diagram showing time taken to display one frame when the liquid crystal panel is divided into two panel regions, as illustrated in FIG. 3, with liquid crystals having the same response rate as liquid crystals in the related liquid crystal panel. As is evident from FIGS. 4A and 4B, the LCD according to the current exemplary embodiment of the present invention has a higher frame rate than that of the conventional LCD. Thus, according to the current exemplary embodiment of the present invention, it is possible to easily improve an LCD frame rate, considering that there is a restriction in increasing the response rate of liquid crystals.

In order to increase brightness as well as frame rate by increasing the time during which light is supplied, each of the first and second panel regions 101 and 102 is further divided into a plurality of sub-regions. The sub-regions are virtual regions that need not be independently driven.

Figure 5:
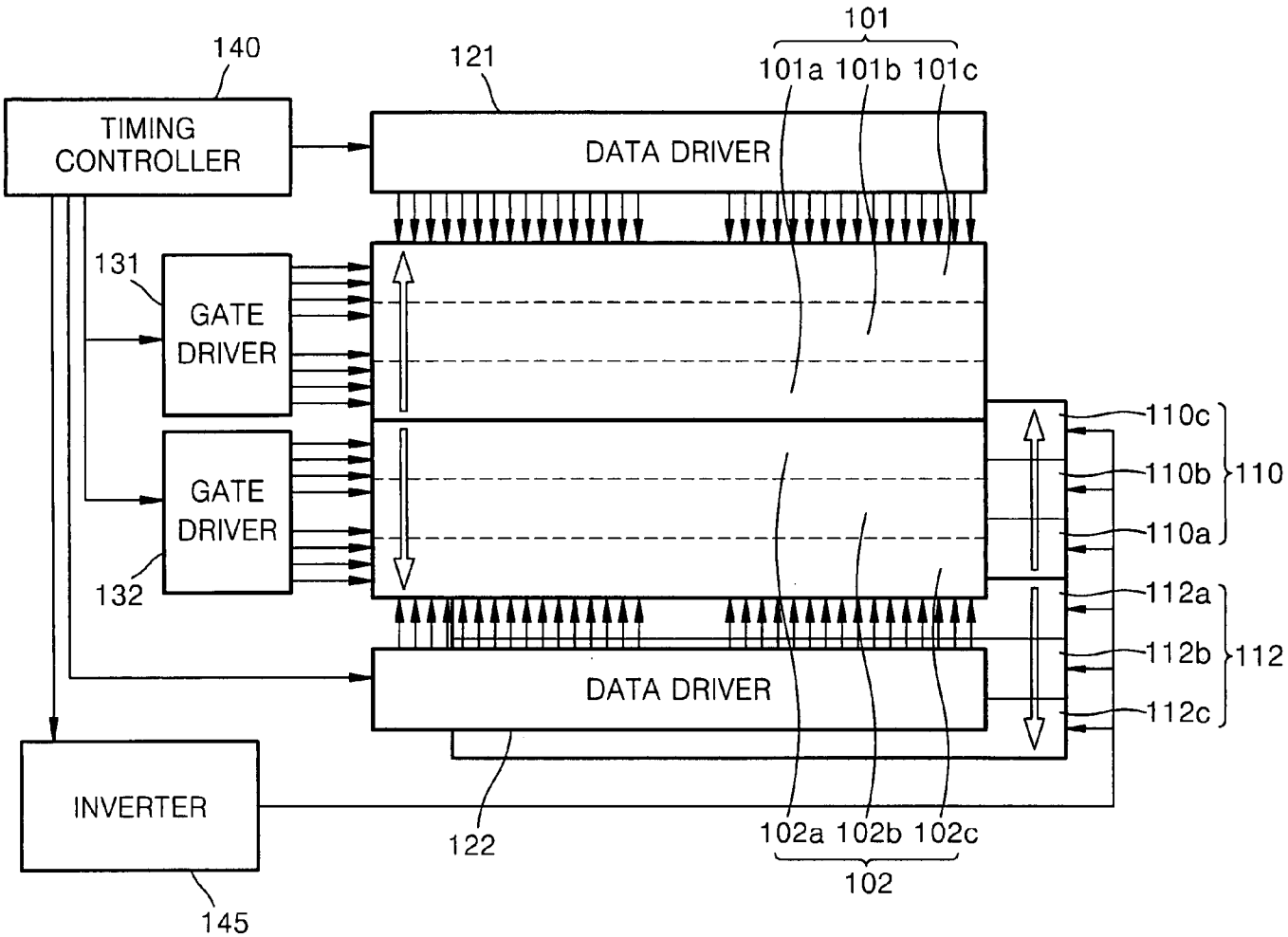
FIG. 5 is a schematic diagram of an LCD according to another exemplary embodiment of the present invention.

Each of the first and second backlight regions 111 and 112 can be further divided into a plurality of sub-regions corresponding to the sub-regions of the first and second panel regions 101 and 102. The sub-regions of the first and second backlight regions 111 and 112 can be driven independently by the inverter 145. FIG. 5 is a schematic diagram of an LCD according to another exemplary embodiment of the present invention. Referring to FIG. 5, a first backlight region 111 contains first through third backlight sub-regions 111*a* through 111*c* and a second backlight region 112 contains fourth through sixth sub-regions 112*a* through 112*c*. A first panel region 101 is partitioned into first through third panel sub-regions 101*a* through 101*c* corresponding to the first through third backlight sub-regions 111*a* through 111*c*. The second panel region 102 is partitioned into fourth through sixth panel sub-regions 102*a* through 102*c* corresponding to the fourth through sixth backlight sub-regions 112*a* through 112*c*.

Figure 6A:
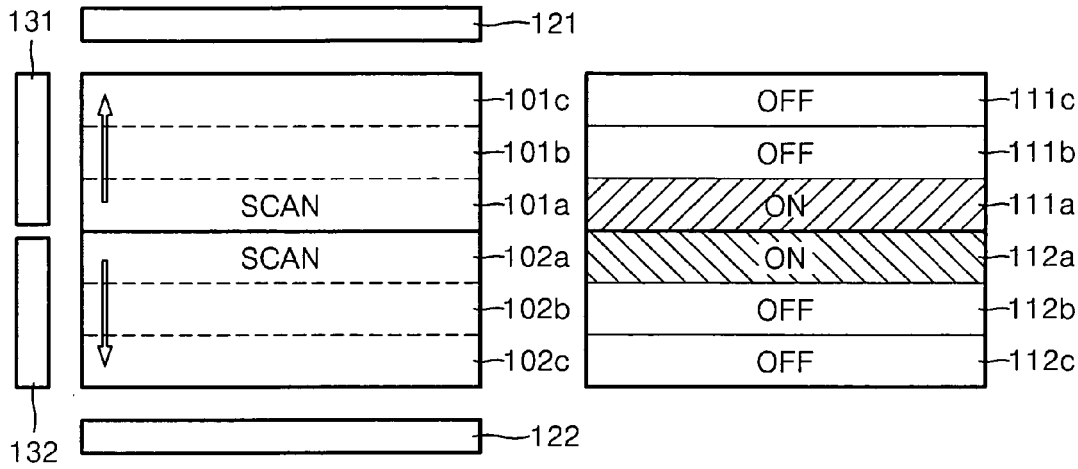
FIGS. 6A-6C are diagrams for explaining a method of driving the LCD of FIG. 5 according to an exemplary embodiment of the present invention.
Figure 6B:
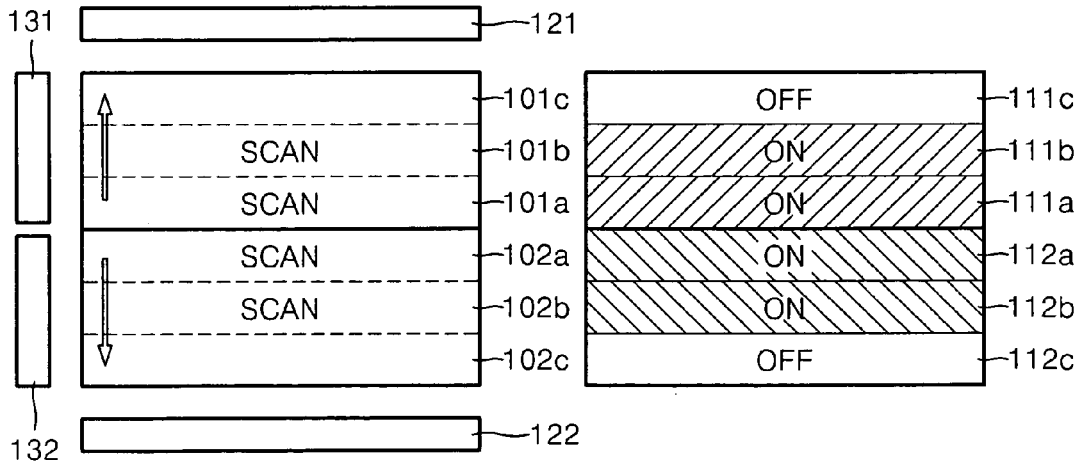
Figure 6C:
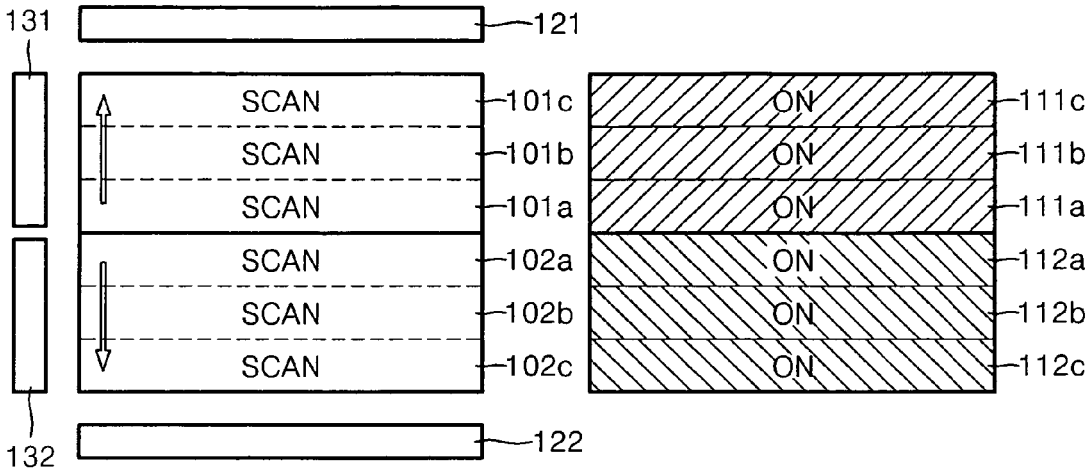

FIGS. 6A-6C are diagrams for explaining a method of driving the LCD of FIG. 5. Referring to FIG. 6A, once a scan of the first and fourth sub-regions 101*a* and 102*a* is completed, light sources in the first and fourth backlight sub-regions 111*a* and 112*a* are turned on to irradiate light on the first and fourth panel sub-regions 101*a* and 102*a* while light sources in the remaining panel sub-regions are turned off. Then, once a scan of the second and fifth panel sub-regions 101*b* and 102*b* is completed, light sources in the second and fifth backlight sub-regions 111*b* and 112*b* are turned on to irradiate light on the second and fifth panel sub-regions 101*b* and 102*b* as illustrated in FIG. 6B. In this case, light sources in the first, second, fourth, and fifth backlight sub-regions 110*a*, 110*b*, 111*a*, and 111*b* are turned on while light sources in the third and sixth backlight sub-regions 110*c* and 111*c* are turned off. Referring to FIG. 6C, after a scan of the third and sixth panel sub-regions 101*c* and 102*c* is completed, light sources in the third and sixth panel backlight sub-regions 111*c* and 112*c* are turned on to irradiate light on the third and sixth panel sub-regions 101*c* and 102*c*. Then, new image data for light of another color is input and light sources in all of the backlight sub-regions 111*a* through 112*c* are turned off before the first and third panel sub-regions 101*a* and 102*a* are scanned according to the new image data. The above process is cyclically repeated, thereby increasing light supply time and brightness of an LCD.

Figure 7:
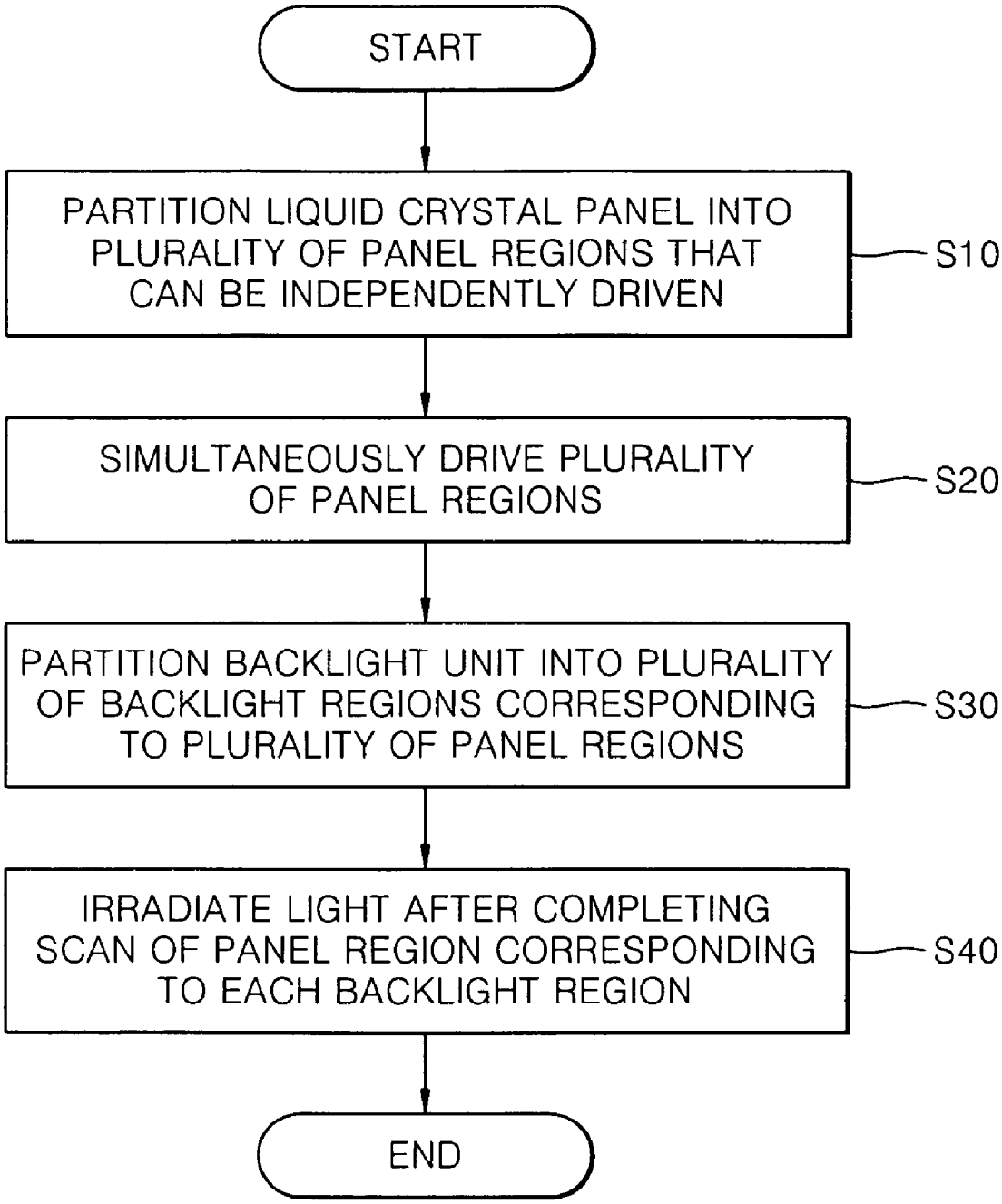
FIG. 7 is a flowchart illustrating a method of driving an LCD according to an exemplary embodiment of the present invention.

FIG. 7 is a flowchart illustrating a method of driving an LCD according to an exemplary embodiment of the present invention. Referring to FIG. 7, in operation S10, a liquid crystal panel having data lines and gate lines is vertically partitioned with respect to the data lines into a plurality of panel regions having substantially the same area and the same shape and that can be independently driven. In operation S20, the plurality of panel regions are driven simultaneously using a data driver and a gate driver for each panel region. In operation S30, a backlight unit for supplying light to the liquid crystal panel is divided into a plurality of backlight regions corresponding to the plurality of panel regions. The plurality of backlight regions may be simultaneously or independently driven. In operation S40, after completing a scan of each panel region, a corresponding backlight region irradiates light to each panel region. Light supplied to each panel region passes through each pixel of a liquid crystal panel with controlled transmittance to produce an image. This process is sequentially performed for each color in the same way. For example, images for R, G, and B color light are sequentially produced and then combined into a single color image.

An LCD according to an exemplary embodiment the present invention has an increased frame rate of a liquid crystal panel while the response rate remains constant by partitioning a liquid crystal panel into panel regions that can be independently driven and simultaneously driving the panel regions, thereby producing high-resolution moving images and large screen images. The number of panel regions can be suitably selected considering the response rate of a liquid crystal panel and a desired frame rate.

Further, the supply time of light can be increased by partitioning each of a plurality of backlight regions into smaller backlight sub-regions and cyclically driving the backlight sub-regions. Each of the backlight sub-regions is independently switched on or off and irradiates light to a corresponding panel region after completing a scan of the panel region. By partitioning each backlight region into smaller sub-regions and increasing the supply time of light, brightness as well as frame rate can be improved.

A method of driving the LCD according to an exemplary embodiment of the present invention can increase a frame rate for a restricted response rate of a liquid crystal panel by partitioning the liquid crystal panel and a backlight unit into a plurality of regions and simultaneously driving the same.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A Liquid Crystal Display (LCD) comprising:

a liquid crystal panel which is partitioned into a plurality of panel regions, each panel region being independently driven and having data lines and gate lines;

a backlight unit which is partitioned into a plurality of backlight regions corresponding to the plurality of panel regions which irradiate light to the plurality of panel regions; and a driver unit which drives the plurality of panel regions;

wherein the plurality of panel regions are driven simultaneously, wherein the plurality of backlight regions are driven simultaneously corresponding to the plurality of panel regions, and wherein each of the backlight regions are vertically partitioned with respect to the data lines into a plurality of sub-regions and light is cyclically supplied from light sources in the plurality of the sub-regions for the panel regions disposed opposite the respective sub-regions.

2. The LCD of claim 1, wherein the driver unit comprises:

a plurality of data drivers, one for each of the plurality of panel regions, which supplies data signals to the data lines;

a plurality of gate drivers, one for each of the plurality of panel regions, which supplies scan signals to the gate lines;

an inverter which drives the backlight unit; and a timing controller which controls the inverter and the data drivers using horizontal synchronization signals and the gate drivers using vertical synchronization signals, respectively.

3. The LCD of claim 1, wherein the backlight unit comprises a plurality of color light sources emitting light of different colors, wherein the liquid crystal panel and the backlight unit are sequentially driven for each color.

4. The LCD of claim 2, wherein the liquid crystal panel is vertically partitioned with respect to the data lines.

5. The LCD of claim 4, wherein the plurality of backlight regions in the backlight unit are driven simultaneously in response to a vertical synchronization signal received from the timing controller.

6. The LCD of claim 1, wherein light is cyclically supplied from light sources in the plurality of the sub-regions after a scan is completed for a panel region disposed opposite the sub-region.

7. A Liquid Crystal Display (LCD) comprising:

a liquid crystal panel which is vertically partitioned into first and second panel regions with respect to data lines, each of the first and second panel regions being independently driven and having data lines and gate lines arranged in a two-dimensional array;

a backlight unit comprising first and second backlight regions that are disposed opposite the first and second panel regions, respectively, which irradiate light to the first and second panel regions and a driver unit which independently drives the first and second panel regions;

wherein the first and second panel regions are simultaneously driven, wherein the first and the second backlight regions are driven simultaneously corresponding to the first and the second panel regions, and wherein each of the first and second backlight regions are vertically partitioned with respect to the data lines into sub-regions and light is cyclically supplied from light sources in a sub-region of backlight regions for a panel region disposed opposite the sub-region.

8. The LCD of claim 7, wherein the driver unit comprises:

a first data driver which supplies data signals to data lines in the first panel region;

a first gate driver which supplies scan signals to gate lines in the first panel region;

a second data driver which supplies data signals to data lines in the second panel region; and a second gate driver which supplies scan signals to gate lines in the second panel region;

an inverter which drives the first and second backlight regions; and a timing controller which controls the first and second data drivers and gate drivers using vertical and horizontal synchronization signals, respectively, and controls the inverter in synchronization with the first and second data drivers.

9. The LCD of claim 7, wherein the backlight unit comprises a plurality of color light sources which emit light of different colors and wherein the liquid crystal panel and the backlight unit are sequentially driven for each color.

10. The LCD of claim 9, wherein light sources in the first and second backlight regions are driven simultaneously in response to a vertical synchronization signal received from the timing controller.

11. The LCD of claim 7, wherein light is cyclically supplied from light sources in a sub-region of backlight regions after a scan is completed for a panel region disposed opposite the sub-region.

12. A method of driving an LCD, comprising:

partitioning a liquid crystal panel having data lines and gate lines into a plurality of panel regions that can be independently driven;

simultaneously driving the plurality of panel regions;

partitioning a backlight unit into a plurality of backlight regions corresponding to the plurality of panel regions; and irradiating light from each of the backlight regions after completing a scan of a corresponding panel region, wherein each of the backlight regions are vertically partitioned with respect to the data lines into a plurality of sub-regions and light is cyclically supplied from light sources in the plurality of the sub-regions for the panel regions disposed opposite the respective sub-regions.

13. The method of claim 12, wherein the driving of the panel regions comprises:

supplying data signals to data lines in the panel regions using data drivers, one for each of the panel regions;

supplying scan signals to gate lines in the panel regions using gate drivers, one for each of the panel regions; and controlling the data drivers and the gate drivers using horizontal and vertical synchronization signals, respectively.

14. The method of claim 12, wherein the backlight unit comprises a plurality of color light sources which emit light of different colors, and wherein the liquid crystal panel and the backlight unit are sequentially driven for each color.

15. The method of claim 12, wherein light sources in the plurality of backlight regions are driven simultaneously in response to a vertical synchronization signal received from the timing controller.

16. The method of claim 12, wherein light is cyclically supplied from light sources in the sub-region of the backlight regions after a scan is completed for the panel region disposed opposite the sub-region.

* * * * *